US007707785B2

(12) United States Patent
Lin

(10) Patent No.: US 7,707,785 B2
(45) Date of Patent: May 4, 2010

(54) VARIABLE GIRDER TIE

(75) Inventor: Jin-Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 113 days.

(21) Appl. No.: 11/591,746

(22) Filed: Oct. 31, 2006

(65) Prior Publication Data

US 2008/0098669 A1 May 1, 2008

(51) Int. Cl.
*E04B 7/04* (2006.01)
*E04B 1/38* (2006.01)

(52) U.S. Cl. ..... 52/92.2; 52/93.2; 52/289; 52/295; 52/713

(58) Field of Classification Search ..... 52/64, 52/92.2, 92.3, 93.1, 93.2, 293.3, 699, 702–704, 52/712, 715, 713, 92.1, 295, 289; 403/232.1, 403/DIG. 15
See application file for complete search history.

(56) References Cited

U.S. PATENT DOCUMENTS

| | | | | | |
|---|---|---|---|---|---|
| 1,787,167 | A | | 12/1930 | Purdy | |
| 2,625,815 | A | * | 1/1953 | Black | 52/126.1 |
| 3,659,884 | A | | 5/1972 | Ohlin | |
| 4,199,908 | A | | 4/1980 | Teeters | |
| 4,321,776 | A | * | 3/1982 | Delight | 52/167.1 |
| 4,327,532 | A | | 5/1982 | Matthews | |
| 4,381,635 | A | | 5/1983 | Solo | |
| 4,449,335 | A | | 5/1984 | Fahey | |
| 4,665,672 | A | * | 5/1987 | Commins et al. | 52/295 |
| 4,744,192 | A | | 5/1988 | Commins | |
| 5,111,632 | A | | 5/1992 | Turner | |
| 5,303,520 | A | * | 4/1994 | Gozdziak | 52/92.2 |
| 5,448,871 | A | | 9/1995 | Newman et al. | |
| 5,553,961 | A | | 9/1996 | Olden | |
| 5,560,156 | A | | 10/1996 | McDonald | |
| 5,575,130 | A | | 11/1996 | Chiodo | |
| 5,577,860 | A | | 11/1996 | Plank | |
| 5,603,580 | A | * | 2/1997 | Leek et al. | 403/232.1 |
| 5,718,533 | A | | 2/1998 | Mullet et al. | |
| 5,732,524 | A | * | 3/1998 | Kalker et al. | 52/712 |
| 5,857,295 | A | | 1/1999 | Mikawa | |
| 5,979,130 | A | * | 11/1999 | Gregg et al. | 52/295 |
| 6,112,495 | A | * | 9/2000 | Gregg et al. | 52/712 |
| 6,158,188 | A | * | 12/2000 | Shahnazarian | 52/702 |
| 6,250,041 | B1 | * | 6/2001 | Seccombe | 52/712 |
| 6,401,422 | B1 | | 6/2002 | Olden | |
| 6,453,634 | B1 | * | 9/2002 | Pryor | 52/713 |
| 6,625,945 | B2 | * | 9/2003 | Commins | 52/293.3 |

(Continued)

OTHER PUBLICATIONS

Hughes Manufacturing, Inc. "Uplift Strap Connectors," 1997/1998 catalog, Hughes Manufacturing, Inc. (Largo, Florida), p. 38. (1997).

(Continued)

*Primary Examiner*—Robert J Canfield
(74) *Attorney, Agent, or Firm*—James R. Cypher; Charles R. Cypher

(57) ABSTRACT

An adjustable connector with a rounded, concave seat and matching washer, a connection and a method of making a connection that ties a first building structural member to a second building structural member in conjunction with fastener means and an anchor member, especially a girder truss to the supporting wall in conjunction with screws and an anchor rod.

17 Claims, 12 Drawing Sheets

U.S. PATENT DOCUMENTS

| | | | | |
|---|---|---|---|---|
| 6,658,796 | B1 | 12/2003 | Higgins | |
| 6,662,517 | B1 | 12/2003 | Thompson | |
| 6,817,157 | B2 * | 11/2004 | Bourque | 52/712 |
| 6,837,019 | B2 * | 1/2005 | Collie | 52/712 |
| 7,412,804 | B1 * | 8/2008 | Bussinger | 52/233 |
| 7,513,083 | B2 * | 4/2009 | Pryor et al. | 52/167.4 |
| 2002/0066247 | A1 * | 6/2002 | Leek | 52/295 |
| 2002/0078657 | A1 | 6/2002 | Zambelli et al. | |
| 2006/0213136 | A1 * | 9/2006 | Lin | 52/295 |

OTHER PUBLICATIONS

Hughes Manufacturing, Inc, "Uplift Strap Connectors," 1996/1997 catalog, Hughes Manufacturing, Inc. (Largo, Florida), p. 36. (1996).

USP Structural Connectors, "Truss & Rafter Tiedowns," USP Full Line Catalog 2004, United Steel Products Company. (Livermore, California) p. 48. (2004).

USP Structural Connectors, "Embedded Truss Anchors," USP Full Line Catalog 2004, United Steel Products Company. (Livermore, California) (2004) pp. 49-53.

USP Structural Connectors, "Strap Truss Tiedowns-SGP series" USP Full Line Catalog 2004, United Steel Products Company. (Livermore, California) p. 54. (2004).

USP Structural Connectors, "Uplift Girder Ties" USP Full Line Catalog 2004, United Steel Products Company. (Livermore, California). {2004}. pp. 55-57.

USP Structural Connectors, "Girder Tiedowns" USP Full Line Catalog 2004, United Steel Products Company. (Livermore, California) (2004) pp. 58-60.

USP Structural Connectors, "Masonry Uplift Connectors-SHA Series" USP Full Line Catalog 2004, United Steel Products Company. (Livermore, California) p. 61. (2004).

USP Structural Connectors, "Truss Straps" USP Full Line Catalog 2004, United Steel Products Company, (Livermore, California) p. 62. (2004).

USP Structural Connectors, "Hurricane Gusset Angles-HGA Series" USP Full Line Catalog 2004, United Steel Products Company. (Livermore, California) p. 63. (2004).

USP Structural Connectors, "Hurricane/Seismic Anchors" USP Full Line Catalog 2004, United Steel Products Company. (Livermore, California). (2004). pp. 64-67.

Simpson Strong-Tie Connectors, "LTA1 Lateral Truss Anchor," C-2000 Catalog, Simpson Strong-Tie Company, Inc. (Pleasanton, California) p. 109 (2000).

Simpson Strong-Tie Connectors, "Heavy Girder Tiedowns," C-2000 Catalog, Simpson Strong-Tie Company, Inc. (Pleasanton, California) p. 109 (2000).

Simpson Strong-Tie Connectors, "Seismic and Hurricane Ties," C-2003 Catalog, Simpson Strong-Tie Company, Inc. (Dublin, California) p. 134 (2003).

USP Structural Connectors, "Truss & Rafter Tiedowns," USP Full Line Catalog 2003, United Steel Products Company, (Livermore, California) (2003) pp. 41-55.

Simpson Strong-Tie Company, Inc., "Wood Construction Connectors," LTA1, LGT2/MGT/HGT, Simpson Strong-Tie Company, Inc. (U.S.A.), front and back page and p. 109 (2000).

Simpson Strong-Tie Company, Inc., "Wood Construction Connectors," Straps & Ties, H Seismis and Hurricane Ties, HL Heavy Angles and Gussets, Simpson Strong-Tie Company, Inc. (U.S.A.), p. 134 (2002).

United Steel Products, "USP Structural Connectors<" USP Full Line Catalog 2004, www.USPconnectors com, United Steel Products (U.S.A.), front and back page and pp. 48, 49, 51-67 (2004).

Simpson Strong-Tie, LTT/MTT/HTT Tension Ties, C-2005 catalog, Simpson Strong-Tie Company, Inc. (Pleasanton, California) p. 25 (2005).

* cited by examiner

VARIABLE GIRDER TIE

BACKGROUND OF THE INVENTION

The roof members of building structures, particularly those located in high wind areas, are often tied down to the supporting wall system to resist the uplift forces caused by winds blowing into, over, and around the structure. Conventionally, these members are tied down to the walls with simple light gauge steel brackets and/or straps which attach to the sides and tops of the roof members and the wall system. The connectors are fastened to the roof and wood wall members with nails or wood screws. The connectors are fastened to concrete or masonry walls with masonry screws, epoxied rods, or are simply embedded into the substrate during construction of the walls. Often the roof is configured such that multiple roof members are supported on one end by the wall and on the other end by a single roof member, commonly referred to as a girder. Each of the roof members which are supported by the girder carry both uplift and download forces which are transferred into the girder through mechanical connections. Often the accumulated forces transferred into the girder can be significant, so much that conventional light gauge connectors do not adequately resist the high uplift forces in the member and as such heavy duty connectors are required to be attached to these girders. Attachment of these heavy duty connectors can be challenging in areas of the country which use concrete or masonry walls because many products are installed to the top of the wall system. This poses problems particularly when products are installed after the framing is complete, which is a common occurrence. Finally, it is standard engineering practice that these high uplift forces are resisted through connector attachment to the top chord of a truss member by either fastening directly to the member or wrapping over the top of the member. Top chord pitches vary widely from job to job and can even vary on the same job in different areas of the roof. The present invention provides a significant improvement on these prior art connectors by offering a connector which can be field adjusted to meet the variable roof pitches and can attach to the face of the wall by means of masonry anchors driven into the constructed wall.

SUMMARY OF THE INVENTION

An object of the present invention is to provide an adjustable connector for connecting an elongate substantially vertical supporting structural member and an elongate generally horizontal supported structural member. This object is achieved by providing a connector with a U-shaped seat that has an obround opening that is elongated from side to side, allowing the connector to rotate while the anchor member remains substantially vertical.

The function of the U-shaped seat is enhanced by providing a matching washer that can maintain a substantially horizontal top surface when the rest of the connector is rotated around it.

A further object of the present invention is to provide a connector that is firmly secured to the generally horizontal supported structural member. This object is achieved by providing back attachment plates that extend from their attachments to the side members down to the level of the seat member, allowing additional fasteners to be driven through them.

A further object of the present invention is to provide a connector that can be used at the ends of generally horizontal supported structural members as well as further in. This object is achieved by providing forms of the connector that have splayed back plates as well as back plates that both bend either left or right together.

DETAILED DESCRIPTION OF THE INVENTION

Figure 1:
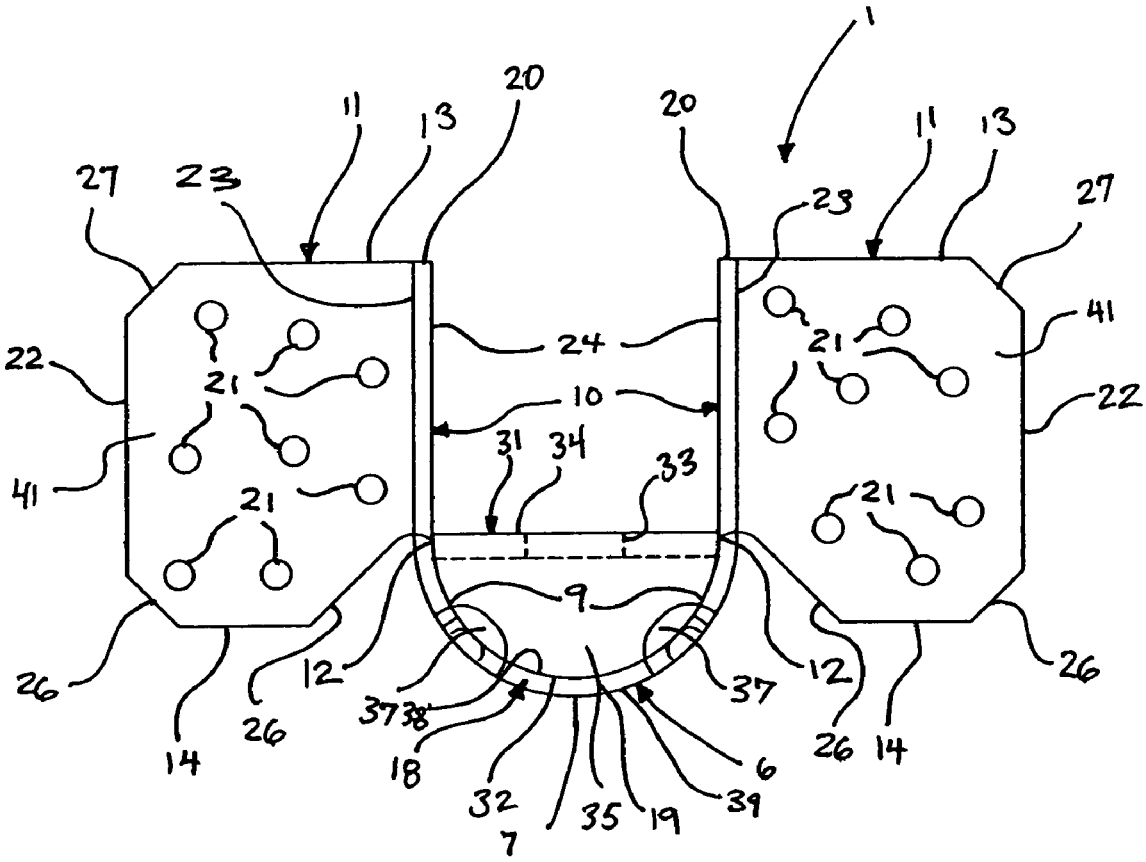
FIG. 1 is a front elevation view of the connector of the present invention.
Figure 2:
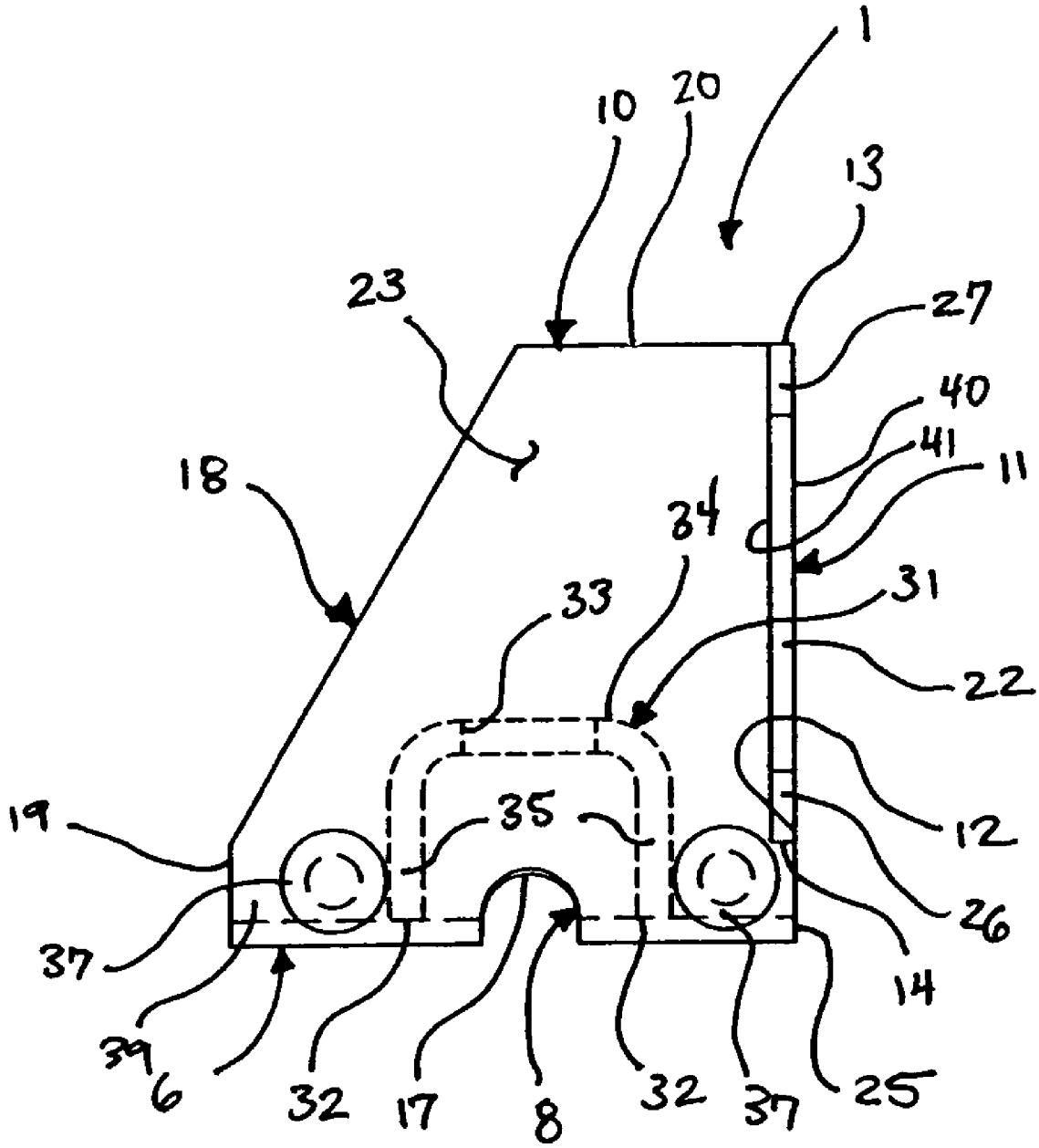
FIG. 2. is a right side elevation view of the connector of the present invention.
Figure 3:
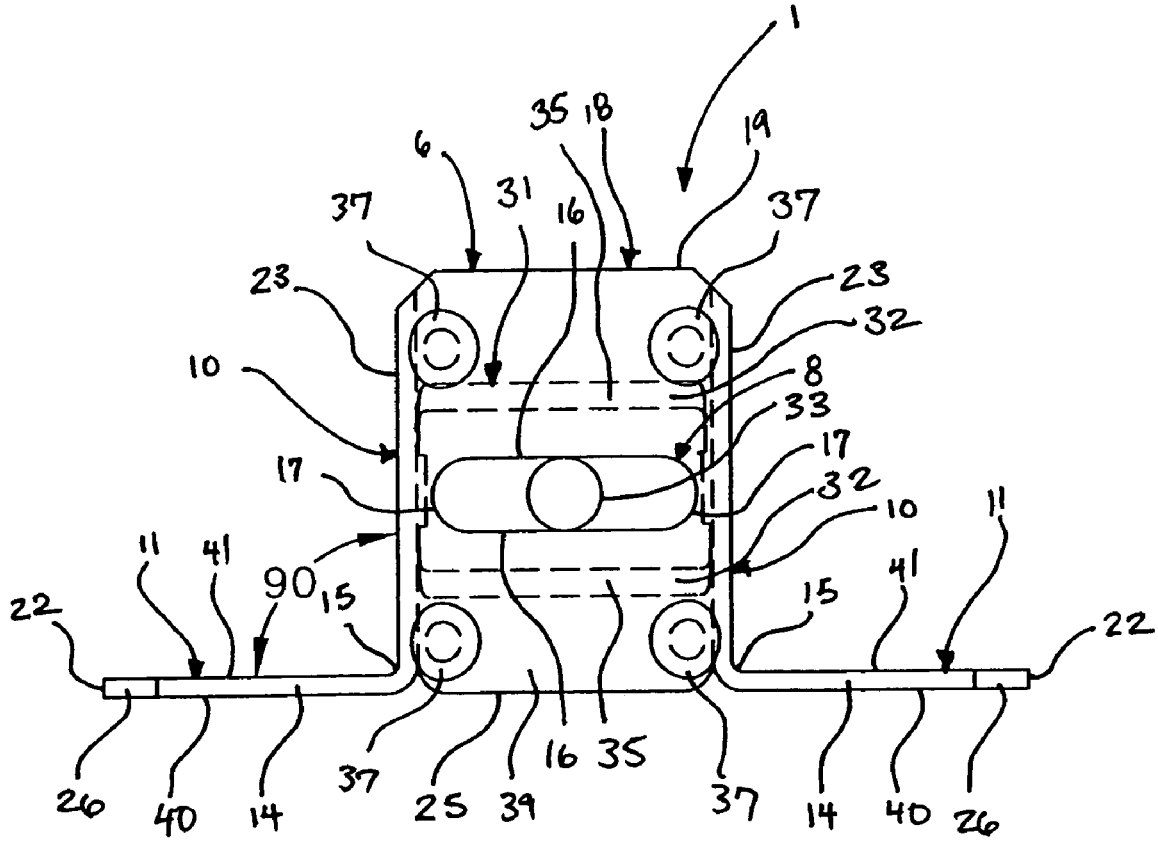
FIG. 3 is a bottom plan view of the connector of the present invention.
Figure 4:
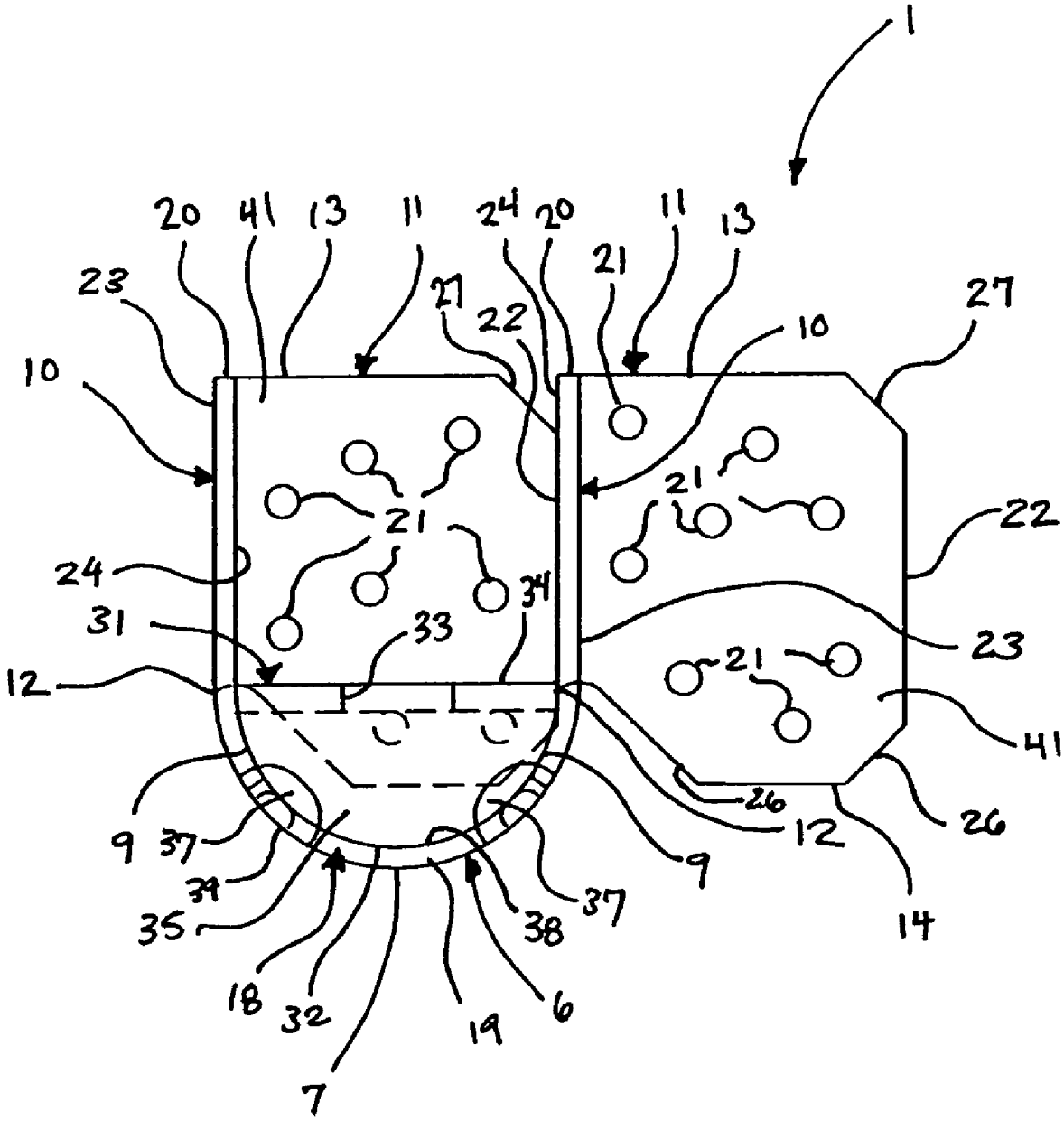
FIG. 4 is a front elevation view of a right-handed connector of the present invention.
Figure 5:
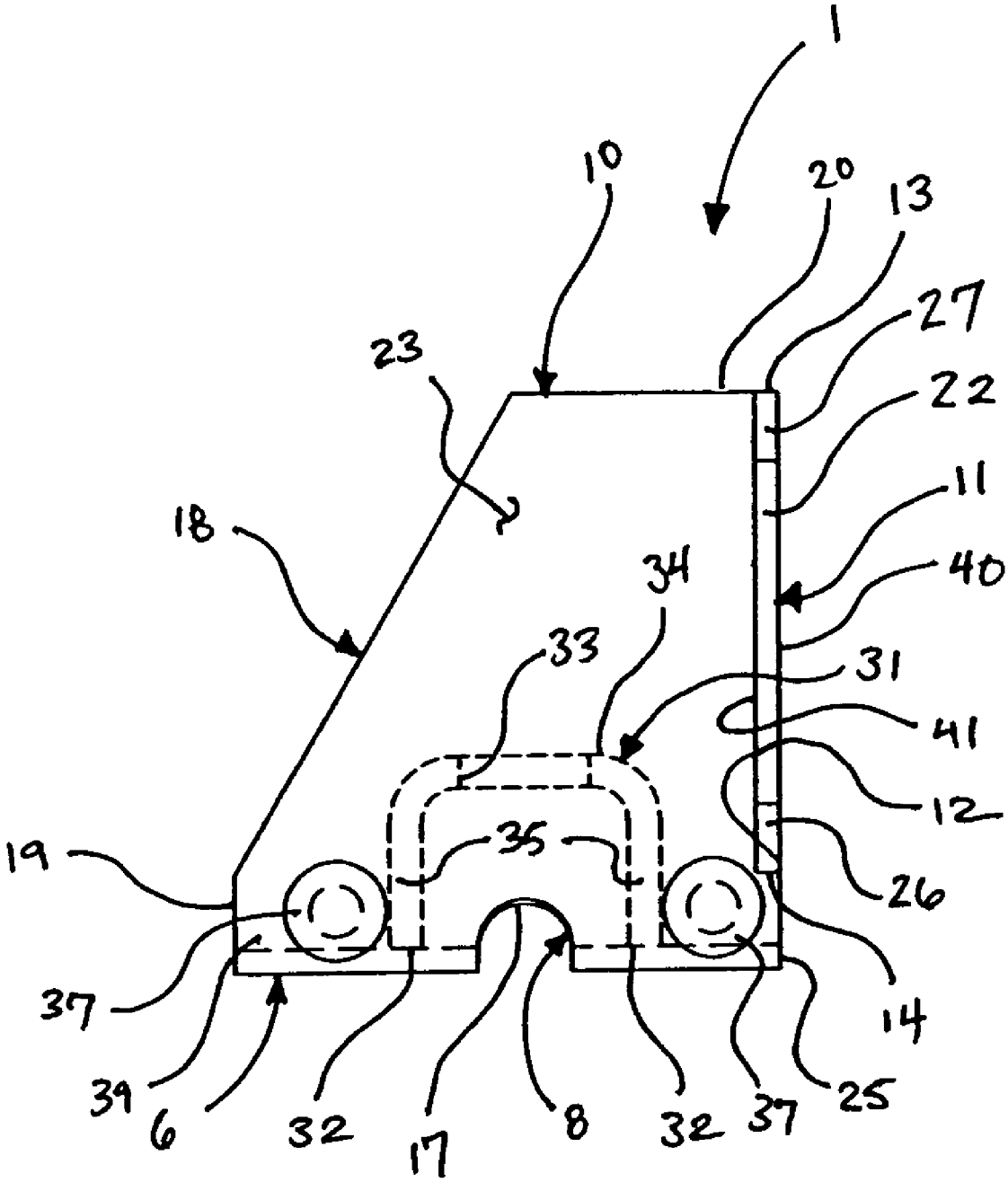
FIG. 5 is a right side elevation view of a right-handed connector of the present invention.
Figure 6:
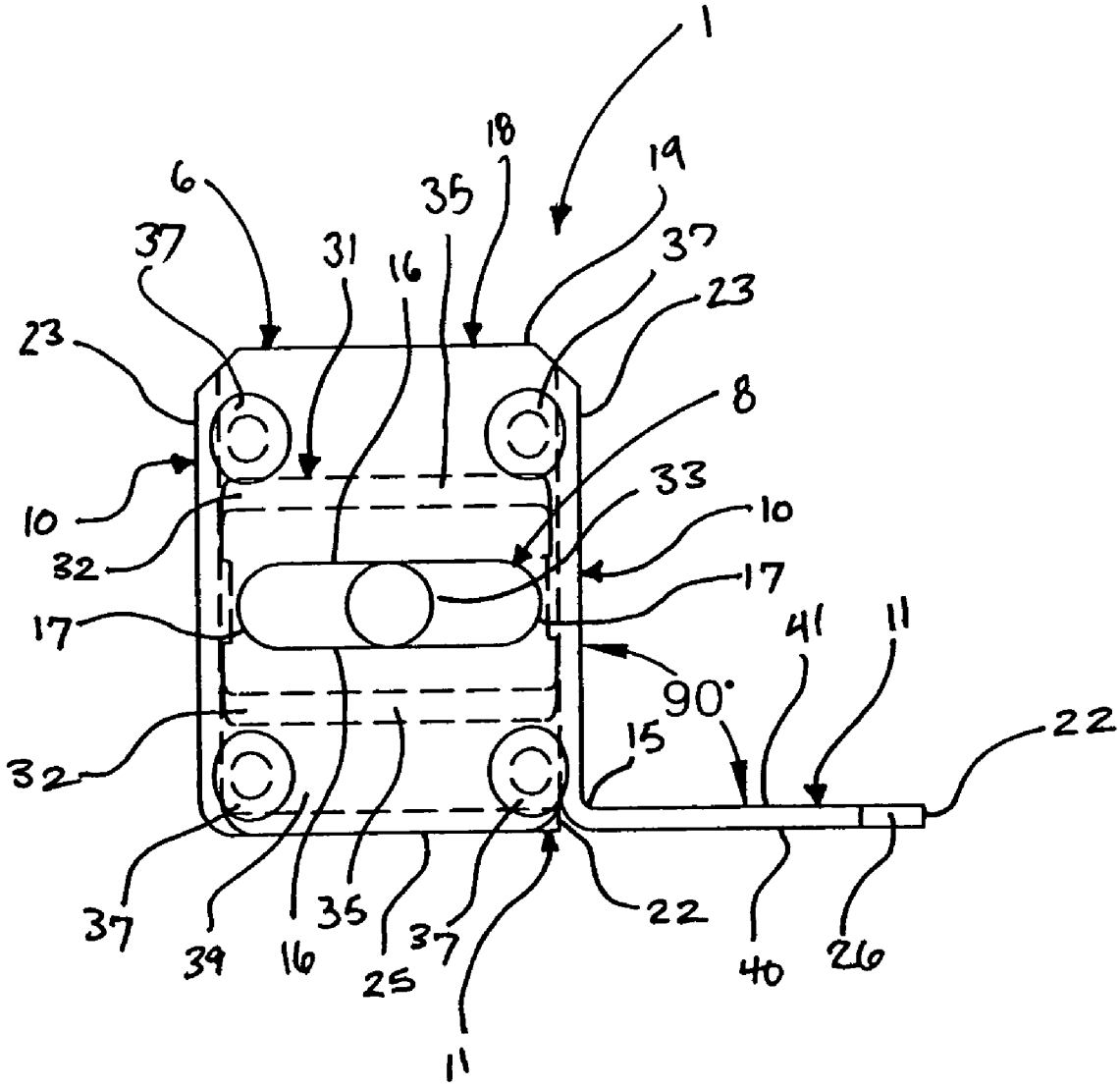
FIG. 6 is a bottom plan view of a right-handed connector of the present invention.
Figure 7:
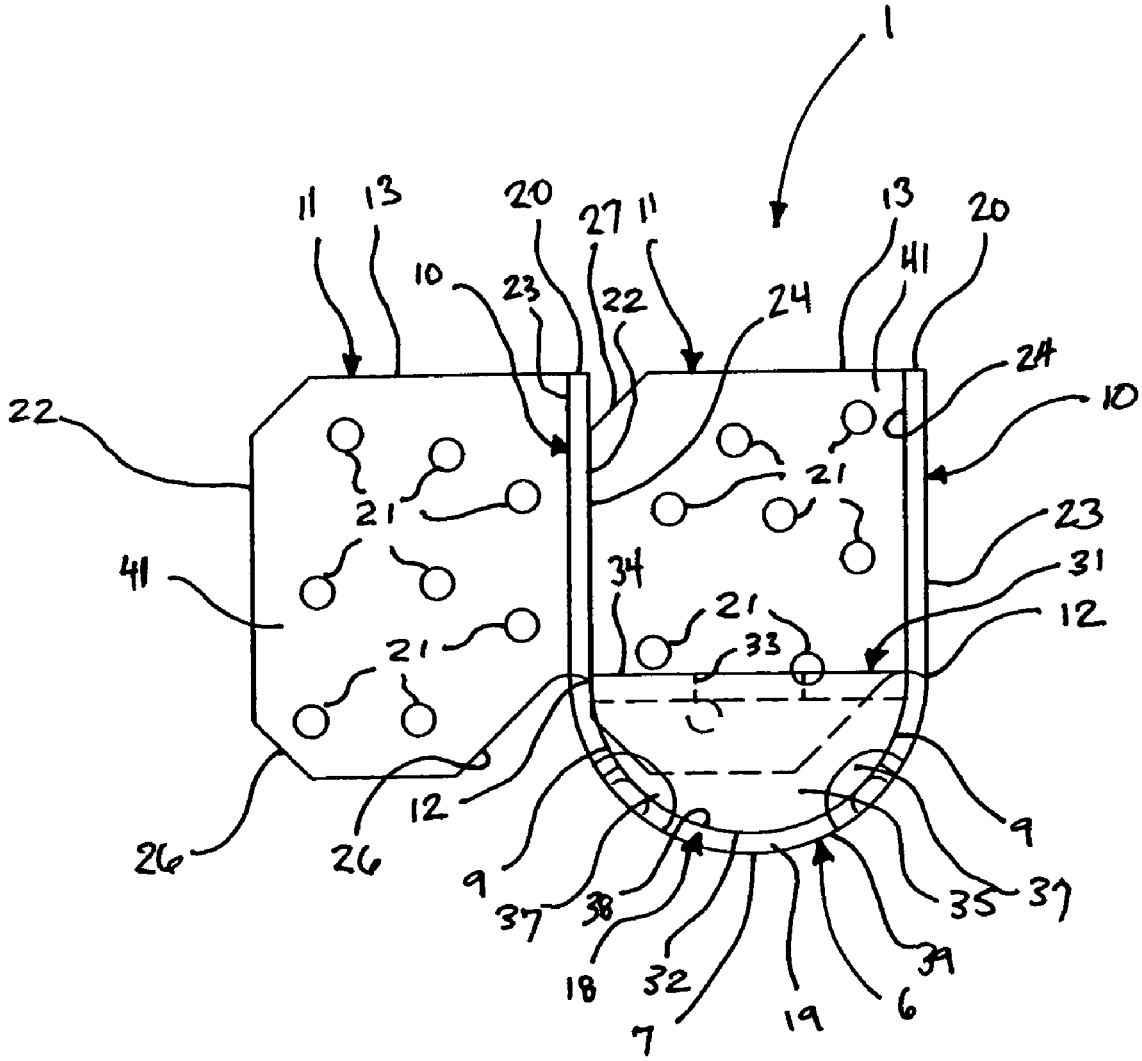
FIG. 7 is a front elevation view of a left-handed connector of the present invention.
Figure 8:
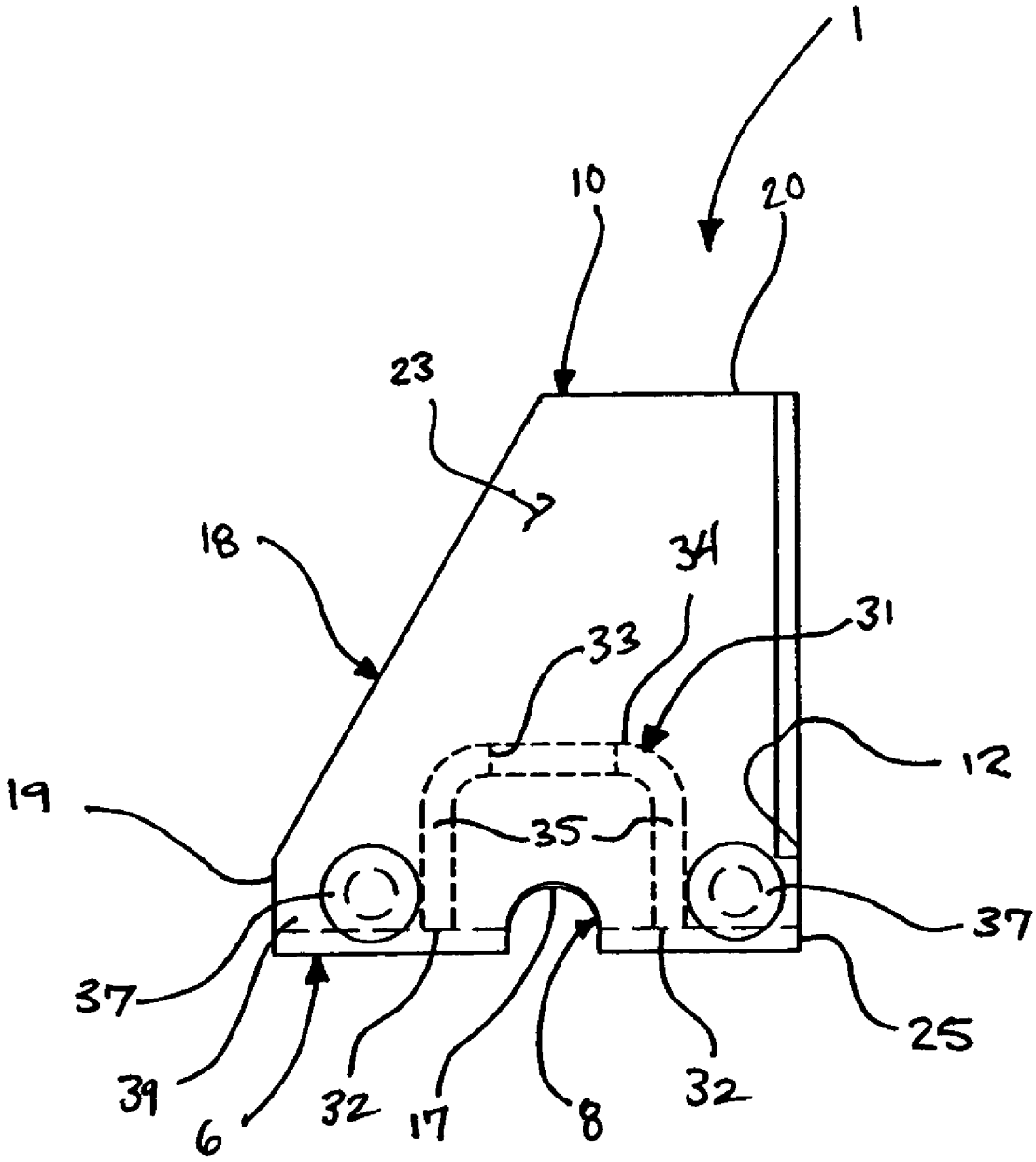
FIG. 8 is a right side elevation view of a left-handed connector of the present invention.
Figure 9:
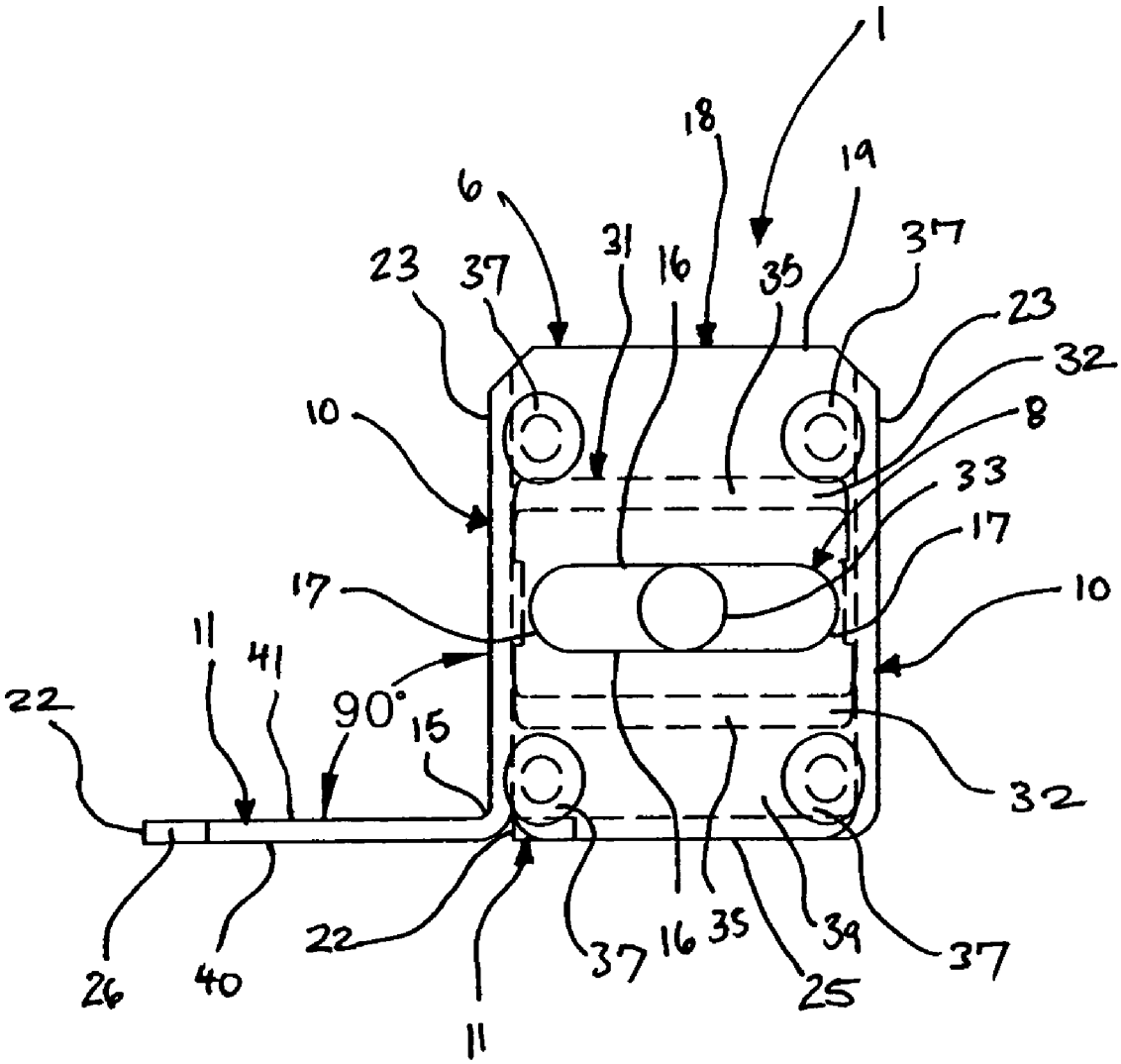
FIG. 9 is a bottom plan view of a left-handed connector of the present invention.

The present invention is a connector 1 for tying a first building structural member 2 to a second building structural member 3 in conjunction with fastener means 4 and an anchor member 5.

Figure 11:
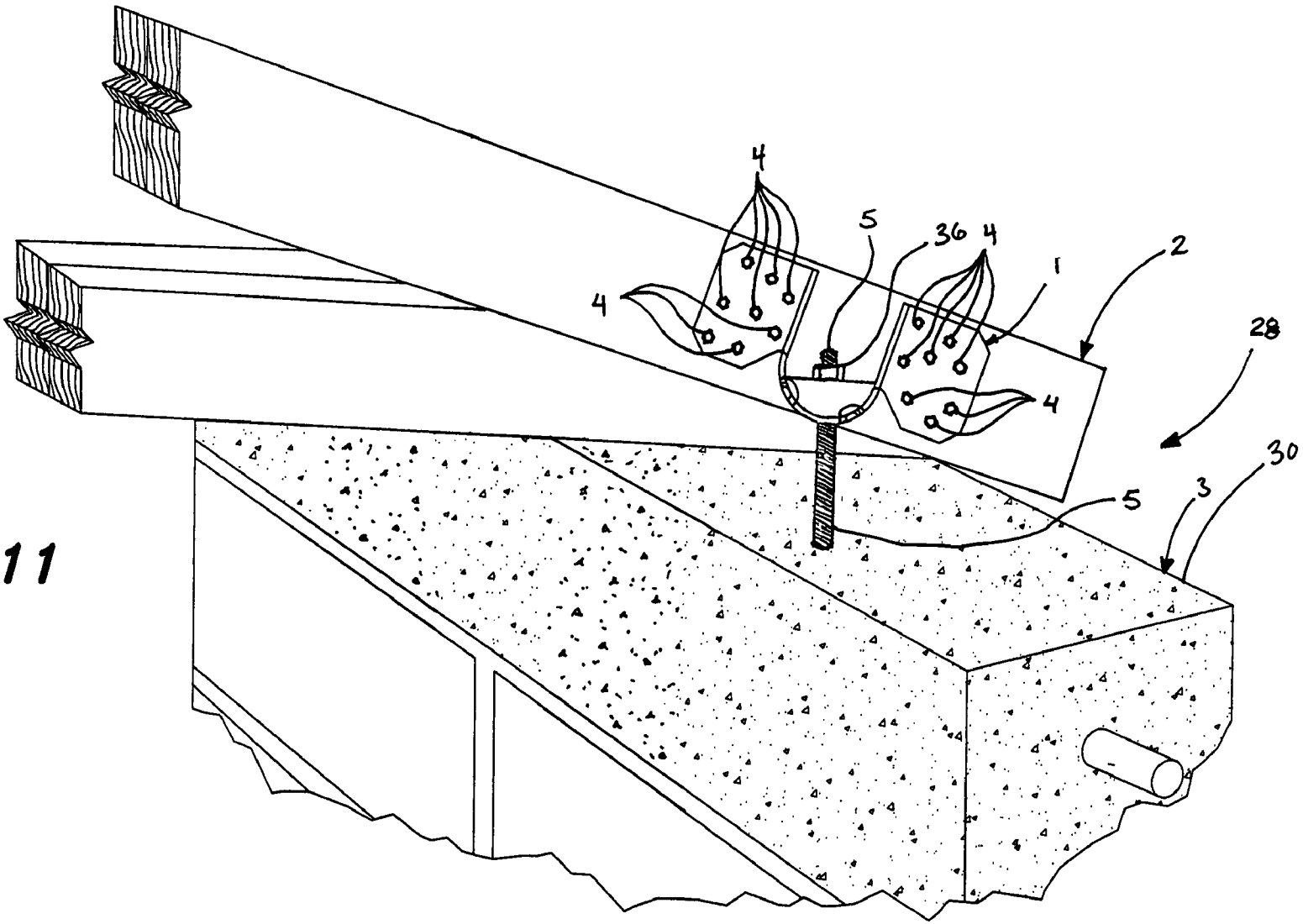
FIG. 11 is a perspective view of the connection of the present invention in which the second building structural member is a masonry wall.
Figure 12:
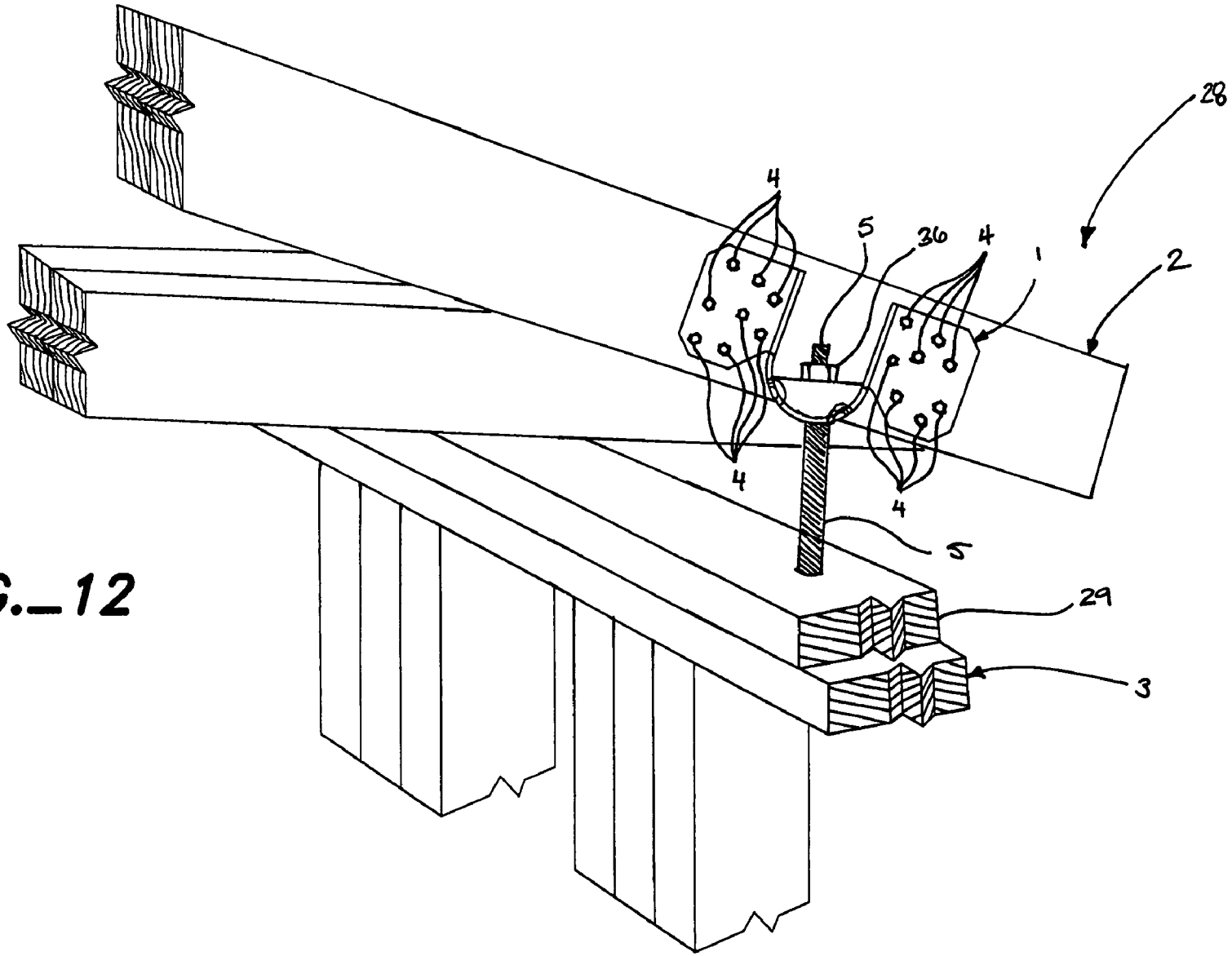
FIG. 12 is a perspective view of the connection of the present invention in which the second building structural member is a wood-framed wall.

As shown in FIGS. 11 and 12, preferably the first building structural member 2 is a truss 2, most preferably a girder truss 2. A girder truss 2 is a heavy truss that generally carries other structural members, such as smaller trusses. Preferably, the first building structural member 2 is made primarily of wood. Preferably, the second building structural member 3 is a wall 3, most preferably a masonry wall 3. Preferably, the fastener means 4 is a plurality of mechanical fasteners 4, most preferably Simpson Strong-Drive wood screws 4, although other mechanical fasteners, as well as adhesives and welding, could be used. The Strong-Drive screw has a hex washer head for driving with a ⅜" hex head socket, a built-in reamer and a type 17 tip that cuts a hole to allow installation without predrilling (depending on the type and moisture content of the wood). If the first building structural member 2 is not made of wood, another fastener 4 would be preferred, such as Simpson Quik Drive TRSD #10 or PHSD #8 steel-to-steel screws for cold-formed steel.

Basically, the connector 1 of the present invention comprises a rounded concave seat member 6, a first side member 10, a second side member 10, a first back plate 11 and a second back plate 11.

Preferably, the connector 1 is formed from 7 gauge G90 (0.173" minimum thickness) galvanized steel. In the most preferred embodiment, the seat member 6 is 2¾" wide, and the distance between the first and second side members 10 is 2¾". In the most preferred embodiment, the seat member 6 has a maximum depth of 3 15/16". In the most preferred embodiment, connector 1 has a front edge 18 that has a curved portion 19 on the seat member 6 that rises to either side from the lowest point 7 of the seat member 6 to a maximum height of approximately 11/16". In the most preferred embodiment, the front edge 18 then angles back at a 30-degree angle from within the seat member 6 to the tops 20 of the first and second side members 10. In the most preferred embodiment, the tops 20 of the first and second side members 10 are the shallowest parts of the connector 1 and are 1 25/32" deep. In the preferred embodiment, the connector 1 is 4 3/16" from the lowest point 7 of the seat member 6 to the tops 20 of the first and second side members 10.

The rounded concave seat member 6 has a lowest point 7 and is formed with an anchor-receiving opening 8 partially at that lowest point 7 of the seat member 6. The opening 8 is formed for receiving the anchor member 5 therethrough to attach the connector 1 to the second building structural member 3. The rounded concave seat member 6 tapers towards the lowest point 7 with tapering portions 9 on either side of the lowest point 7. Preferably, the opening 8 is obround, having first and second flat sides 16 and first and second rounded ends 17, the first and second rounded ends 17 oriented to face the first and second side member 10, respectively. In the most preferred embodiment, the obround opening 8 is 2 5/8" long and 0.688" wide. In the most preferred embodiment, the obround opening 8 is 2 3/32" from the front edge 18 of the connector 1 at the lowest point 7 of the seat member 6. The seat member 6 has a concave inner surface 38 and a convex outer surface 39.

The first side member 10 is integrally connected to the concave seat member 6, and the second side member 10 is also integrally connected to the concave seat member 6. The first back plate 11 is integrally connected to the first side member 10, and the second back plate 11 is also integrally connected to the second side member 10. The first back plate 11 is formed to interface with the fastener means 4 to attach the first back plate 11 to the first building structural member 2. The second back plate 11 is also formed to interface with the fastener means 4 to attach the second back plate 11 to the first building structural member 2. Preferably, the first and second back plates 11 are each formed with a plurality of fastener openings 21. In the most preferred embodiment, each of the first and second back plates 11 has eight fastener openings 21. Each of the first and second back plates 11 has a back interface side 40 that interfaces with the first building structural member 2 and a front opposite side 41.

In the most preferred embodiment, the fastener openings 21 in the first back plate 11 are spaced on center as follows: a first fastener opening 21 is 13/16" from the outer edge 22 and 1/2" from the upper edge 13 of the first back plate 11; a second fastener opening 21 is 1 11/16" from the outer edge 22 and 11/16" from the upper edge 13 of the first back plate 11; a third fastener opening 21 is 2 11/32" from the outer edge 22 and 1 1/16" from the upper edge 13 of the first back plate 11; a fourth fastener opening 21 is 9/16" from the outer edge 22 and 1 7/8" from the upper edge 13 of the first back plate 11; a fifth fastener opening 21 is 1 19/32" from the outer edge 22 and 1 13/16" from the upper edge 13 of the first back plate 11; a sixth fastener opening 21 is 2/1132" from the outer edge 22 and 2 3/16" from the upper edge 13 of the first back plate 11; a seventh fastener opening 21 is 1/2" from the outer edge 22 and 1/2" from the lower edge 14 of the first back plate 11; an eighth fastener opening 21 is 1 7/16" from the outer edge 22 and 1/2" from the lower edge 14 of the first back plate 11.

In the most preferred embodiment, the fastener openings 21 in the second back plate 11 are spaced on center as follows: a first fastener opening 21 is 2 5/26" from the outer edge 22 and 13/32" from the upper edge 13 of the second back plate 11; a second fastener opening 21 is 1 1/4" from the outer edge 22 and 19/32" from the upper edge 13 of the second back plate 11; a third fastener opening 21 is 2 5/16" from the outer edge 22 and 1 5/8" from the upper edge 13 of the second back plate 11; a fourth fastener opening 21 is 1 5/8" from the outer edge 22 and 1 1/4" from the upper edge 13 of the second back plate 11; a fifth fastener opening 21 is 11/16" from the outer edge 22 and 1 3/16" from the upper edge 13 of the second back plate 11; a sixth fastener opening 21 is 1 7/8" from the outer edge 22 and 2 19/32" from the upper edge 13 of the second back plate 11; a seventh fastener opening 21 is 31/32" from the outer edge 22 and 1/2" from the lower edge 14 of the second back plate 11; an eighth fastener opening 21 is 17/32" from the outer edge 22 and 2 7/16" from the upper edge 13 of the second back plate 11.

This distribution of the fastener openings 21 is designed to prevent wood splitting in the first structural member 2. In the most preferred embodiment, the fastener opening 21 closely match the diameter of the mechanical fasteners 4 that they receive.

Figure 10:
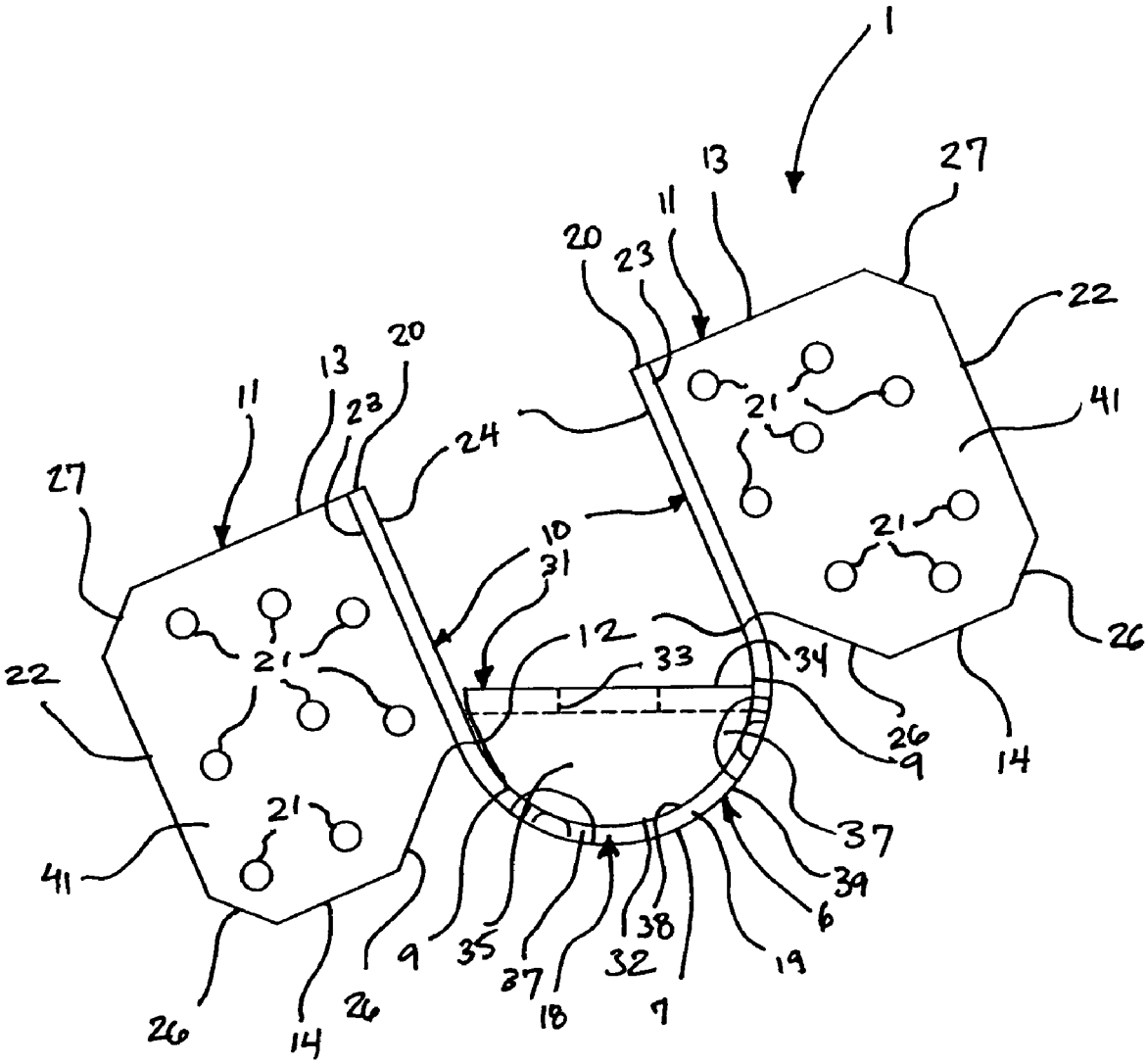
FIG. 10 is a front elevation view of the connector of the connector of the present invention with all of the connector apart from the washer member rotated counterclockwise.

Preferably, the connector 1 also has a washer member 31 with a rounded lower surface 32 that matches the concavity of the seat member 6 and an anchor-receiving opening 33 formed for receiving the anchor member 5 therethrough. As shown in FIG. 10, the rounded lower surface 32 of the washer member 31 would allow the upper surface 34, which is preferably flat, to remain horizontal when the rest of the connector 1 is rotated to match the pitch of the first building structural member 2 to which it is attached. In the most preferred embodiment, the washer member 31 has an n-shaped profile with roughly semicircular front and back legs 35. In the most preferred embodiment, the opening 35 in the washer member 30 is round and closely matches the circumference of the anchor member 5 that it receives. In the most preferred embodiment, the anchor member 5 is an anchor rod 5 that is 5/8" diameter all thread rod (ATR), and it is restrained against the upper surface 34 of the washer member 30 with a nut 36 that is threaded onto the anchor rod 5.

Preferably, the washer member 31 is held in the seat member 6 by four washer retaining dimples 37 embossed into the seat member 6, two adjacent the front leg 35 and two adjacent the back leg 35. In the most preferred embodiment, the dimples 37 are preferably round domes, each with a maximum height within the seat member 6 of 0.219" and a diameter of 0.625". In the most preferred embodiment, the two front dimples 37 are 23/32" on center from the front edge 18 at the lowest point 7 of the seat member 6; the two back dimples are 1/2" on center from the back edge 25 of the seat member 6. The dimples 37 are 9/32" on center from the inner surface 38 at the lowest point 7 of the seat member 6.

In the most preferred embodiment, the first and second back plates 11 each have an outer edge 22, and each of the first and second back plates 11 is 2 3/4" wide from the first and second side members 10, respectively, to the respective outer edges 22. In the most preferred embodiment, the first and second back plates 11 are bent outward away from each other to left and right, so that the outer edges 22 face away from each other, and the connector 1 is 8 9/16" wide from one outer edge 22 to the other outer edge 22. As shown in FIGS. 4 through 9, in an alternate preferred embodiment, one of the first and second back plates 11 is bent inward, between the first and second side members 10, so that both back plates 11 are bent in the same direction, and the connector 1 is 5 27/32" wide from the outer surface 23 of one side member 10 to the outer edge 22 of the back plate 11 connected to the other side member 10. In this alternate preferred embodiment, both back plates 11 are bent to the left or to the right, allowing for installation where the portion of the first structural member 2 above the second structural member 3 is not wide enough to accommodate a connector 1 with splayed back plates 11. Preferably, the first and second back plates 11 are bent at 90-degree angles to the first and second side members 10, respectively, joining the first and second side members 10 at first and second bends 15. The first and second bends 15 preferably have a radius one times the material thickness of the connector 1.

The lowest point 7 of the seat member 6 is substantially midway between the first side member 10 and the second side member 10. In the most preferred embodiment, the lowest point 7 of the seat member 6 is 1⅜ between the inner surface 24 of the first side member 10 and the inner surface 24 of the second side member.

Preferably, at least a portion of the seat member 6 lies between a portion of the first back plate 11 and a portion of the second back plate 11. Preferably, the back edge 25 of the seat member 6 will be the only portion of the seat member 6 that lies between portions of the first and second back plates 11.

Preferably, the seat member 6 joins the first side member 10 at a first juncture line 12 and the second side member 10 at a second juncture line 12. The first juncture line 12 and the second juncture line 12 preferably lie in a common plane. Preferably, a portion of the first back plate 1 lies on the same side of the common plane 13 as the seat member 6, and a portion of the second back plate 11 lies on the same side of the common plane 13 as the seat member 6.

The first back plate 11 preferably has a first lower edge 14 that joins the first side member 10 at a first intersection 15, and the second back plate 11 has a second lower edge 14 that joins the second side member 10 at a second intersection 15. Preferably, a portion of the first back plate 11 lies on the same side of the first intersection 15 as the seat member 6, and a portion of the second back plate 1 lies on the same side of the second intersection 15 as the seat member 6. In the most preferred formed of the invention, the first and second lower edges 14 of the first and second back plates 11 each have a 45-degree ½" chamfer 26 where they meet the outer edges 22 of the first and second back plates 11. In the most preferred embodiment, the first and second lower edges 14 of the first and second back plates 11 each have a slightly longer 45-degree chamfer 26 where they meet the bends 15 between the first and second back plates 11 and first and second side members 10. In the most preferred form of the invention, the first and second back plates 11 each have an upper edge 13 that has a 45-degree ½" chamfer 27 where they meet the outer edges 22 of the first and second back plates 11. In the most preferred embodiment, the first and second back plates 11 each have a maximum height of 3½".

As shown in FIGS. 11 and 12, the present invention includes the connector 1 in a connection 28. In the connection 28, the first back plate 11 is attached to the first building structural member 2 by fastener means 4, and the second back plate 11 is also attached to the first building structural member 2 by fastener means 4. The anchor member 5 is received by the anchor-receiving opening 8 in the seat member 6, and the anchor receiving member 5 is secured to the connector 1. The anchor member 5 also is secured by the second building structural member 3.

Preferably, the fastener means 4 are mechanical fasteners 4 that pass through the first and second back plates 11 and into the first building structural member 2. The anchor member 5 is preferably an anchor rod 5.

Preferably, the second building structural member 3 is a wall 3 that supports the first building structural member 2. As shown in FIG. 12, in one embodiment the wall 3 is preferably a wood-framed wall 3. If so, the wall 3 preferably has a top plate 29 and the anchor rod 5 passes through the top plate 29, preferably through a hole drilled in the top plate 29. Preferably, the anchor rod 5 would be secured below the top plate 29 with a nut threaded onto the anchor rod 5 in combination with a washer. As shown in FIG. 11, in another embodiment the wall 3 is a preferably a masonry wall 3. If so, the wall 3 has a top portion 30 and the anchor rod 5 is embedded in the top portion 30. The anchor rod 5 could be embedded before the masonry sets, or it could be dropped into a hole drilled in the masonry and fixed there with an epoxy adhesive.

In the basic method of making the connection 28 of the present invention, one attaches the first back plate 11 to the first building structural member 2. One attaches the second back plate 11 to the first building structural member 2. One passes the anchor member 5 through the anchor-receiving opening 8 in the seat member 6 and secures the anchor member 5 to the connector 1. One also secures the anchor member 5 to the second building structural member 3.

I claim:

1. A building connection (28) comprising a connector (1), a first building structural member (2), a second building structural member (3), fastener means (4), and an anchor member (5), said connector (1) tying said first building structural member (2) to said second building structural member (3) in conjunction with said fastener means (4) and said anchor member (5), said connector (1) comprising:

a. a rounded concave seat member (6) with a lowest point (7), formed with an anchor-receiving opening (8) partially at said lowest point (7) of said seat member (6), said opening (8) formed for receiving said anchor member (5) therethrough to attach said connector (1) to said second building structural member (3);

b. a first side member (10) integrally connected to said concave seat member (6);

c. a second side member (10) integrally connected to said concave seat member (6);

d. a first back plate (11) integrally connected to said first side member (10), said first back plate (11) being formed to interface with said fastener means (4) to attach said first back plate (11) to said first building structural member (2);

e. a second back plate (11) integrally connected to said second side member (10), said second back plate (11) being formed to interface with said fastener means (4) to attach said second back plate (11) to said first building structural member (2); wherein:

i. said lowest point (7) is substantially midway between said first side member (10) and said second side member (10);

ii. said first back plate (11) is attached to said first building structural member (2) by a plurality of said fastener means (4);

iii. said second back plate (11) is attached to said first building structural member (2) by a plurality of said fastener means (4);

iv. said anchor member (5) is received by said anchor-receiving opening (8) in said seat member (6);

v. said anchor member (5) is secured to said connector (1);

vi. said anchor member (5) is secured by said second building structural member (3);

vii. said first building structural member (2) is a roof member (2);

viii. said second building structural member (3) is a wall (3);

ix. said anchor member (5) is secured through an upward-facing portion of said wall (3);

x. said connector (1) is in direct contact with said first building structural member (2) only along vertical portions of said first building structural member; and xi. said anchor-receiving opening (8) has an elongated length compared to a relatively narrow width and the length of said anchor-receiving opening (8) extends along said seat member (6) substantially from said first side member (10) to said second side member (10).

2. The connection (28) of claim 1, additionally comprising:

a. a washer member (31) with a rounded lower surface (32) that matches the concavity of said seat member (6) and an anchor-receiving opening (33) formed for receiving said anchor member (5) therethrough.

3. The connection (28) of claim 1, wherein:

a. at least a portion of said seat member (6) lies between a portion of said first back plate (11) and a portion of said second back plate (11).

4. The connection (28) of claim 1, wherein:

a. said seat member (6) joins said first side member (10) at a first juncture line (12);

b. said seat member (6) joins said second side member (10) at a second juncture line (12);

c. said first juncture line (12) and said second juncture line (12) lie in a common plane;

d. a portion of said first back plate (11) lies on the same side of said common plane as said seat member (6); and e. a portion of said second back plate (11) lies on the same side of said common plane as said seat member (6).

5. The connection (28) of claim 1, wherein:

a. said first back plate (11) has a first lower edge (14) that joins said first side member (10) at a first intersection (15);

b. said second back plate (11) has a second lower edge (14) that joins said second side member (10) at a second intersection (15);

c. said first lower edge (14) extends below the uppermost extent of said seat member (6); and d. said second lower edge (14) extends below the uppermost extent of said seat member (6).

6. The connection (28) of claim 1, wherein:

a. said fastener means (4) are mechanical fasteners (4) that pass through said first and second back plates (11) and into said first building structural member (2).

7. The connection (28) of claim 6, wherein:

a. said anchor member (5) is an anchor rod (5).

8. The connection (28) of claim 7, wherein:

a. said wall (3) is a wood-framed wall (3).

9. The connection (28) of claim 8, wherein:

a. said wall (3) has a top plate (29) and said anchor rod (5) passes through said top plate (29).

10. The connection (28) of claim 7, wherein:

a. said wall (3) is a masonry wall (3).

11. The connection (28) of claim 10, wherein:

a. said wall (3) has a top portion (30) and said anchor rod (5) is embedded in said top portion (30).

12. A method of making the connection (28) of claim 6, said method comprising:

a. selecting a connector (1) as defined in claim 6;

b. attaching said first back plate (11) to said first building structural member (2);

c. attaching said second back plate (11) to said first building structural member (2);

d. passing said anchor member (5) through said anchor-receiving opening (8) in said seat member (6);

e. securing said anchor member (5) to said connector (1); and f. securing said anchor member (5) to said second building structural member (3).

13. The connection (28) of claim 1, wherein:

a. said first structural member (2) is a truss (2).

14. The connection (28) of claim 13, wherein:

a. said first structural member (2) is a girder truss (2).

15. The connection (28) of claim 5, wherein:

a. said first back plate (11) has a plurality of fastener openings (21);

b. said second back plate (11) has a plurality of fastener openings (21); and c. at least one of said fastener openings (21) in said first back plate (11) and said second back plate (11) is level with said tapering portions (9) of said seat member (6).

16. The connection (28) of claim 1, wherein:

a. said first back plate (11) and said second back plate (11) are both on the same side of said first side member (10).

17. The connection (28) of claim 1, wherein:

a. said first back plate (11) and said second back plate (11) are both on the same side of said second side member (10).

* * * * *